United States Patent [19]

Scott et al.

[11] Patent Number: 4,920,947

[45] Date of Patent: May 1, 1990

[54] CHAIN SAW COMPONENTS AND SYSTEM FOR CUTTING MASONRY AND THE LIKE

[75] Inventors: Lewis A. Scott, Lake Oswego; Francis E. Hoffman, Gresham; Kenneth R. Bolkan, Estacada, all of Oreg.

[73] Assignee: Blount, Inc., Portland, Oreg.

[21] Appl. No.: 181,437

[22] Filed: Apr. 14, 1988

[51] Int. Cl.[5] ..... B28D 1/08

[52] U.S. Cl. ..... 125/21; 125/22; 30/381; 83/830; 51/266; 51/267

[58] Field of Search ..... 125/21, 22; 76/25 R, 76/DIG. 5; 51/136, 357, 206, 207, 266, 267; 30/381, 383, 384; 83/830, 832, 833, 834

[56] References Cited

U.S. PATENT DOCUMENTS

| | | | |
|---|---|---|---|
| 2,869,534 | 1/1959 | Stihl | 125/21 |
| 2,912,968 | 11/1959 | Stihl . | |
| 3,593,700 | 7/1971 | McNulty | 125/21 |
| 3,613,749 | 10/1971 | Geurian | 83/830 |

OTHER PUBLICATIONS

Mark's Standard Handbook for Mechanical Engineers, pp. 13–42, "Surfacing by Welding".

*Primary Examiner*—Frederick R. Schmidt
*Assistant Examiner*—M. Rachuba
*Attorney, Agent, or Firm*—Robert L. Harrington

[57] ABSTRACT

A chain saw for cutting aggregate materials including a saw chain of interconnected center links and side link paris composed of heat-treated steel. Certain pairs of the side links support diamond impregnated matrix cutting blocks that are laser welded to the side links in a process where the laser beam is focused and orbited along the juncture to avoid stress risers in the steel material of the supporting side links. Drawing down of the zone adjacent the weld also is controlled to avoid stress risers. The guide bar is provided with a pattern of enclosed channels for directing water to the guide bar groove at spaced positions on the periphery of the guide bar edge for flushing away the aggregate dust generated by the cutting process. The channels are angularly directed toward the guide bar nose and have incrementally increased cross sections on progressing toward the guide bar nose to enhance the flushing operation. To reduce adhesvie wearing of the bearing surfaces, as between the saw chain components and as between the saw chain and guide bar, the guide bar rails, the rivet holes, and depending center link tang portions of the saw chain are hard-surfaced.

3 Claims, 2 Drawing Sheets

CHAIN SAW COMPONENTS AND SYSTEM FOR CUTTING MASONRY AND THE LIKE

FIELD OF THE INVENTION

This invention relates to a chain saw particularly with regard to the chain and guide bar being adapted to cutting stone and aggregate materials such as cement block, concrete walls and the like.

BACKGROUND OF THE INVENTION

A chain saw is commonly used to fell, buck and delimb trees. The saw chain, the power head and the coupling components that made up a wood cutting chain saw have been highly developed. The steel cutting links of the saw chain slide along a steel guide bar at a high rate of speed driven by a drive sprocket connected to the drive shaft of the power head. The guide bar is a plate-like member with an oval guide edge provided with a guide slot flanked by guide rails. The saw chain is made up of interconnected center and side link pairs. The center links include a depending tang that slides in the guide groove and the side links have bottom edges that slide on the guide rails.

The cutting links which are commonly provided as one of the side links of each pair of side links, have an upwardly or outwardly extended portion formed into forwardly directed cutting edges. These cutting edges engage the wood body and cut out wood chips.

The entire process of wood cutting with a chain saw involves metal sliding on metal and metal pounding on metal in reaction to the fast moving chain engaging the wood and removing chips. The wear problem is extremely acute and yet has been largely overcome by metal processing technologies that provide hard metal where wear resistance is desirable, ductile metal where fatigue resistance is desirable, etc. All of this enables the production of a commercially feasible wood cutting tool, i.e. a chain saw with a reasonable life expectancy at a reasonable cost.

Cutting concrete, stone and other hard, brittle materials requires a different type of cutting edge than that used to cut wood. Typically such materials are cut with small cutting blocks composed of a metal matrix having graded industrial diamond particles impregnated therein. The blocks are attached to a cutting tool, i.e. to the periphery of a circular blade, or to a steel cable. Most commonly used are the circular blades, and the chain saw of the present invention will be compared to the circular blade in demonstrating the benefits of the invention.

The circular blades are driven by a shaft through the blade center. The blade has to be quite large in comparison to the depth of cut desired. For example, the diameter of the blade needs to be about three times the required depth of cut. Thus, if a ten inch wall is to be cut, the blade has to be about thirty inches in diameter. The power head for driving such a blade has to be correspondingly powered and the power head and diamond carrier blade in combination make up a very costly cutting tool. A guide bar and chain for a chain saw designed for a comparable operation (thickness of material to be cut) is about 8% of the weight and volume of a circular saw blade. This is indicative of the benefits to be derived from a satisfactory concrete cutting chain saw.

The circular blade has a further problem in a fairly common concrete cutting situation. The exposed cutting face of the circular saw is the partial circumference of a circle, i.e. about a 120 degree segment of a circle. As long as the cutting area of the blade can be extended clear through the thickness of the material and then continued past both ends of the material being cut, the circular cutting face is not a problem. But consider for example a concrete wall that is 10 inches thick and extends between a ceiling and a floor. When the blade has been fully projected up and down the wall (but without being extended into the floor or ceiling) there remains a substantial uncut portion of the wall that may extend as much as 6 inches or so down from the ceiling and up from the floor. This remaining portion has to be cut by another tool and previously no such tool existed that was considered satisfactory for the task.

Chain saws have, of course, been considered. A patent as early as May 2, 1899, U.S. Pat. No. 624,400, disclosed the use of a cutting chain for cutting earth and rock. More recently aggregate cutting saw chain and chain saws were disclosed in U.S. Pat. No. 2,912,968 (Nov. 17, 1959), U.S. Pat. No. 3,545,422 (Dec. 8, 1970), U.S. Pat. No. 3,593,700 (July 20, 1971), and U.S. Pat. No. 4,181,115 (Jan. 1, 1980). To out knowledge, none have been successful.

There are several problems that are encountered by chain saws that do not exist for circular saws. The saw chain and guide system involve numerous parts sliding against each other. The side links and center links pivot relative to each other on rivets or pins; the side link bottom edges slide on the guide bar rails; and center link drive tangs slide in the guide bar groove. Whereas technology developed heretofore enables this sliding relationship for wood cutting, that is not the case for aggregate cutting.

When cutting cement and stone, fine particles are ground out of the aggregate medium creating a dust that settles on the saw chain and its components. This dust gets between the sliding parts of the bar and chain links and acts as an abrasive to rapidly wear the hardest of steel surfaces. Also the heat that is generated in cutting the hard aggregate materials is so high that similar steel to steel sliding creates an "adhesive" type of wear between engaging parts. This is an inherent welding action that takes place due to the extensive heat that is generated between the parts. Beads of the material are formed in this welding process that break off as particles. Over a period of time (a relatively short period of time where this process is continuous) the engaging surfaces are rapidly worn away.

The above problems are however, secondary. The primary problem is the provision of a cutting element with sufficient life. Obviously if the cutting element cannot be retained by the saw chain for any period of time, the fact that the moving or sliding parts are rapidly wearing is of little consequence. The cutting element that is desired for cutting through aggregate material is a metal matrix impregnated with diamonds. It is not practical to make the cutting links entirely of this material.

Most commonly the bar and saw chain links are made of steel as in wood cutting chain and a cutting block of the diamond impregnated matrix is bonded to the saw chain. Typically, the side links have upper body portions that are configured to support the cutting blocks and the cutting blocks are bonded to a saw chain link as by brazing. All such attempts have failed either because the bond wouldn't hold, the bonding process detrimentally effected the wear life of the chain, the chain became too costly, or a combination of all three.

Nothing prior to this invention has been successfully developed to secure a cutting block to the saw chain sufficiently to withstand the extreme abuse that is encountered in an aggregate cutting operation.

SUMMARY OF THE INVENTION

The present invention provides features to overcome the problems previously encountered by saw chain designs used for cutting aggregate materials. The problem of adhesive wearing is overcome by providing dissimilar materials at the interface of the sliding surfaces. The bar rails are laminated with stellite strips and the center link tangs and interior of the bearing holes are coated with chrome. These materials are dissimilar from the steel materials from which the chain links and rivets are constructed and they are also very hard materials that resist abrasive wearing.

Abrasive wearing in large part is prevented by a flushing system provided by channels formed in the guide bar body and a compatible chain arrangement whereby the channels are open clear through to the kerf being cut to provide water flow outwardly of the chain and bar. This water flow cools the bar and chain, and carries the concrete dust away from the chain parts. The flushing system includes passages through the bar that are varied in cross section for pressure consistency and are directed along the cutting edge in the direction of the moving chain to create a continuous flow of water and dust carried thereby through and out of the kerf being cut.

The problem of adequately bonding the cutting block to the side links has been solved by laser welding. It is theorized that brazing and other forms of welding which apply heat to the steel substrate, create various weaknesses in the support link. For example, in some instances the welding process effects a drawing action to weaken the steel. In other instances, stress risers will be created. The laser welding process provided herein has been found to overcome that problem. The laser beam is focused and then orbited. The heat is thereby disseminated to a broader area. The weld is cooled under controlled temperature but without the undesired drawing effect. Stress risers are thereby also avoided. The result is a superior weld whereby the cutting blocks are retained on the saw chain and the wear properties of the saw chain are retained, making the chain saw a practical tool for cutting aggregate.

The invention will be more fully understood by reference to the following detailed description having reference to the accompanying drawings wherein.

DESCRIPTION OF PREFERRED EMBODIMENT OF THE INVENTION

Figure 1:
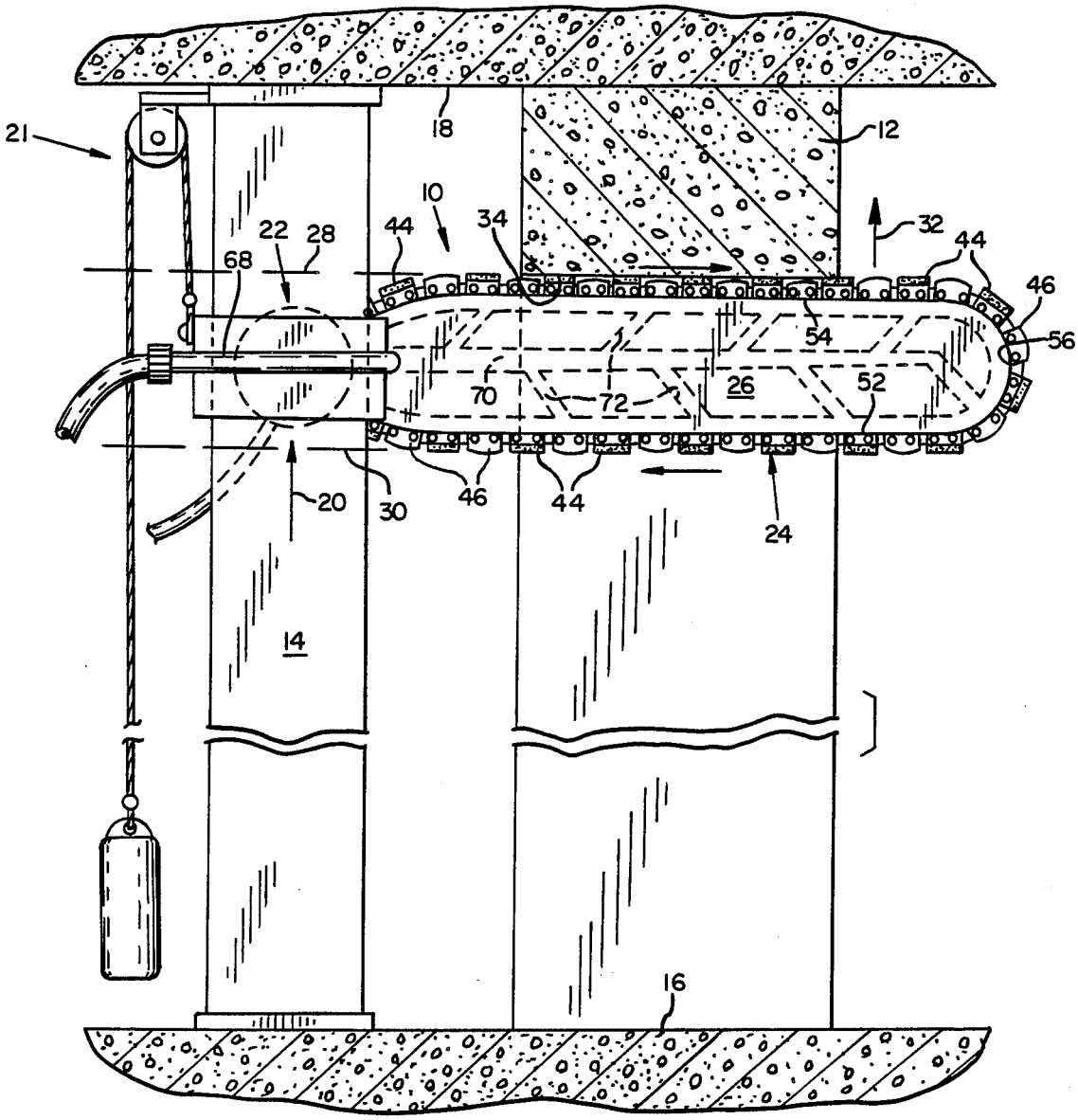
FIG. 1 is a schematic illustration of a chain saw of the present invention, in operation cutting a concrete wall extended between a floor and ceiling.

Reference is made to FIG. 1 wherein a specialized chain saw 10 is applied to the task of cutting through a thick concrete wall 12. The chain saw 10 is mounted to a guide post 14 that is placed by the operator between the floor 16 and ceiling 18. The chain saw is designed to travel on the post as indicated by arrow 20. The movement of the chain saw along the post is typically accomplished by a semiautomatically driven gear mechanism that is in common use and not part of the present invention. Accordingly the specifics of the guide mechanism are now shown. Here the saw is illustrated being urged upwardly under the influence of pulley and weight combination 21.

It is important to note that the power head 22 is confined within the upper and lower reaches of the saw chain 24 (sometimes called a cutting chain) as the chain travels around the guide bar 26. The upper and lower reaches are indicated in FIG. 1 by dash lines 28,30 and as will be further noted, a substantial portion of the travel of the saw chain (through the thickness of wall 12) essentially follows these dash lines 28,30. This enables the chain saw 10 to cut entirely through the wall to the ceiling 18 and floor 16 without cutting into either the ceiling or floor. (Note the flush cut made through wall 12 to the juncture with the floor 16.)

The chain saw is cutting in an upward direction as indicated by arrow 32, forming a kerf 34. The direction of cut can be readily reversed simply by changing the direction of the cutting chain 24, in that the cutting elements can cut in either direction. As will be seen in FIGS. 3 and 4 (and which will be further explained hereafter), the kerf 34 non-cutting components of the guide bar 26 and saw chain 24.

Figure 2:
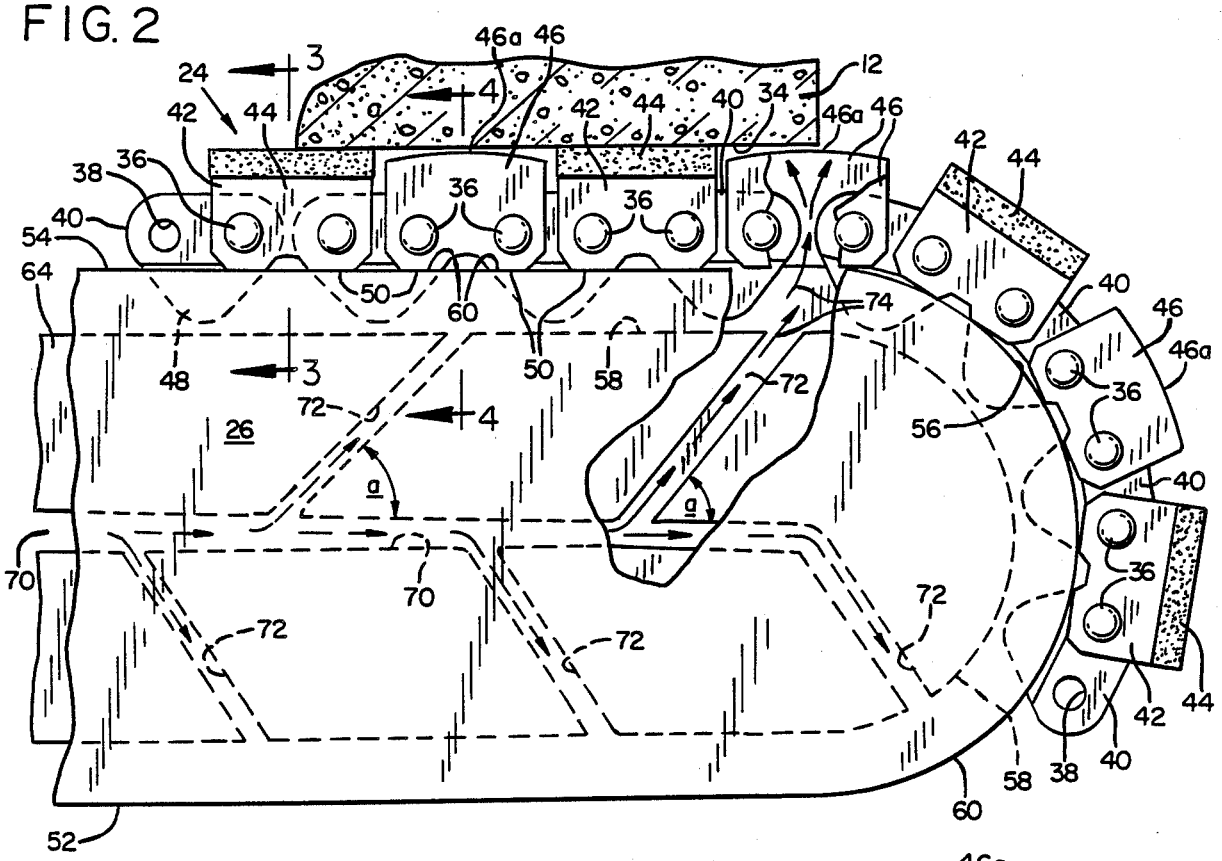
FIG. 2 is an enlarged view of a portion of the saw chain and guide bar of the chain saw of FIG. 1.
Figure 3:
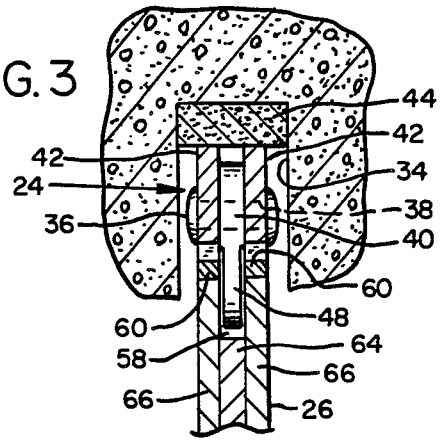
FIG. 3 is a section view of a cutting link as taken on view line 3—3 of FIG. 2.
Figure 4:
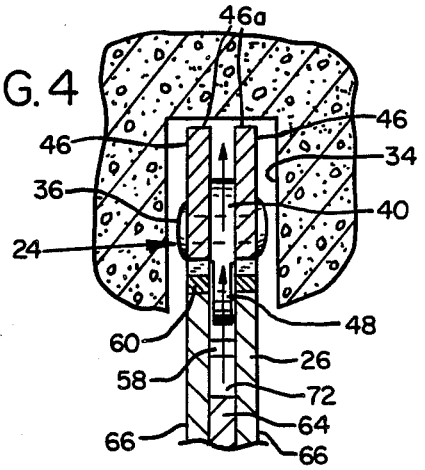
FIG. 4 is a section view of the alternate side links as taken on view line 4—4 of FIG. 2.

Reference is now also made to FIGS. 2–4 illustrating more specifically the saw chain 24. As illustrated the saw chain is made up of a series of interconnected links. The links are connected by pins, or rivets, 36 that project through rivet holes 38 provided in the links. This interconnection allows the limited pivoting or articulation of the chain enabling free bending within the restricted confines of the saw chain design and limited to directional bending dictated by the multiple axes of the pins 36. What this means is that the chain is free to follow an oval path of travel around the guide bar 26.

The links of the saw chain 24 include alternating center links 40 and pairs of side links 42,46. Side links 46 have upwardly (or outwardly) extended support portions that support a cutting block 44. The block 44 spans the width of the cutting chain 24 and is attached to the tops of opposed side links 42 to unify the pair of side links and thereby form a single cutting element.

Between succeeding cutting elements (unified pairs of side links 42) are pairs of planar, substantially parallel, laterally spaced side links 46 having upwardly (or outwardly) extended depth gauge portions **46*a*. Opposed side links 46** are spaced apart to form an opening that extends upwardly between the leading and trailing center links.

The center links 40 include depending (inwardly directed) drive tang portions 48. The drive tang portions 48 and the bottom edges 50 of the side links (both pairs) cooperate to guide the chain around the guide bar, as will become apparent from the following description of the guide bar 26.

As noted in FIG. 1, the guide bar 26 has substantially straight bottom and top guide edges 52, 54 and an interconnecting semicircular nose-end edge 56. As seen in FIG. 2, a groove 58 is provided continuously along the edges 52, 56 and 54. Bearing strips 60 (secured to the top edges or rails of the side laminates of the bar as seen in FIGS. 3 and 4, one on each side of the groove 58), support the bottom edges 50 of the side links with the drive tang portions 48 of the center links entrained in groove 58.

A drive sprocket driven by a drive shaft is contained inside the housing of power head 22 (FIG. 1) to rapidly drive the chain 24 around guide bar 26 with the tang portion 48 of the center links sliding in guide bar groove 58 and bottom edges 50 of the side links sliding on bearing strips 60.

From the above it will be apparent that the operation of the chain saw involves substantial surface-to-surface sliding of metal parts. The drive tangs 48 slide in the groove 58. The bottom edges 50 slide on the bearing strips 60. The center links and side links are pivoted with the center links turning on the pins or rivets 36.

It should also be apparent from FIG. 2 that in the process of cutting a kerf 34 through the wall 12, the aggregate material making up the concrete wall 12 is ground away as tiny bits of material that can be referred to as concrete dust. This concrete dust will settle on all the exposed surfaces and will work into the interface between mating surfaces. As the surface slide relative to one another the dust particles grind away at the surfaces and rapidly wear those surfaces. It is accordingly desirable to remove the dusts or, to the extent possible, prevent the dust from settling on the saw chain and guide bar surfaces. In the present embodiment this problem of dust settling on the bar and chain is largely alleviated by a flushing system.

As seen in FIGS. 3 and 4, the guide bar 26 is a laminated structure comprising a core laminate 64 and side laminates 66. As is conventional for laminate bars used for wood cutting, the core laminate is configured relative to the side laminates so as to product the groove 58. The core laminate is distinguished from the prior guide bars by the channels 70,72 formed in one side thereof as illustrated in FIG. 2. These channels 70,72 direct water flow from a water line 68 (FIG. 1). Water flows into the central channel 70 which runs substantially the length of the bar. Feeding channels 72 project outwardly from the central channel 70 and water flows into the bar groove 58 as indicated by arrows 74 in FIG. 2. These feeding channels 72 are angled forwardly, e.g. by the indicated angle a and are spaced along the length of the bar to provide a plurality of spaced water outlets, e.g. every few inches along the bar length.

The feeding channels 72 are varied in cross section. Near the rear end of the bar, nearest water line 68, the channels are smaller in cross section, and progressing forwardly on the bar succeeding feeding channels have increasingly greater cross section. This compensates for pressure drop and provides the generally same flushing capability along the bar length. The water flow is of course more or less restricted as the various saw chain links pass over the feeding channel openings. It is particularly open all the way to the kerf 34 as the depth gauge side links 46 cross the channel opening. Note the break-away in FIG. 2 with arrows 74 projected up through the chain.

With the open flow of water in the forwardly directed channels, the flow of water is directed along the direction of saw chain travel as the saw chain is cutting through the kerf 34. Thus the force of the water flow from the feeding channels and the movement of saw chain travel cooperate to direct the water toward and around the nose end of the bar. This water flow movement picks up the aggregate dust and carries it away from the saw chain and guide bar interfaces.

A further benefit of the water flushing system is the cooling of the saw chain and guide bar. The friction created by the sliding surfaces generates very high temperatures. The water flow is very beneficial in reducing this temperature. Extreme temperatures nevertheless result from the action of grinding or cutting away the hard aggregate materials and whereas the flushing operation largely eliminates concrete dust and thereby reduces the abrasive wearing problem, it only marginally reduces the adhesive wearing problem caused by the high temperature. To alleviate the adhesive welding, dissimilar materials are provided on the major sliding interfaces. The bearing strips 60 are constructed of stellite. The process of applying a wear strip to the guide bar edge is already developed in the saw chain art, but to the bar nose to reduce heat-generated wearing at the nose end. Thus the steel bottom edges 50 of the side links ride on the dissimilar stellite strips 60.

Chrome plating is also an art developed for wood cutting saw chain, primarily to enhance the harness of cutters. For the present application the surface around rivet holes 38 and drive tang portion 48 are chrome plated to provide the dissimilar surfaces.

The above improvements are all important for extending the life of a saw chain in the very difficult task of cutting aggregate materials. However, they are all secondary to the need for having a cutting element that will stand up. Whereas a diamond impregnated matrix block 44 is capable of cutting the aggregate, previously there has been no satisfactory carrier for this cutting material other than a circular blade. When bonded to a saw chain carrier, the result has generally been unsatisfactory. The process developed to solve this problem will not be explained.

THE BONDING PROCESS

Figure 5:
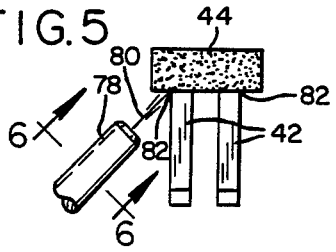
FIG. 5 is a view illustrating the cutting link only and the process of laser welding the cutting element to the base link.
Figure 6:
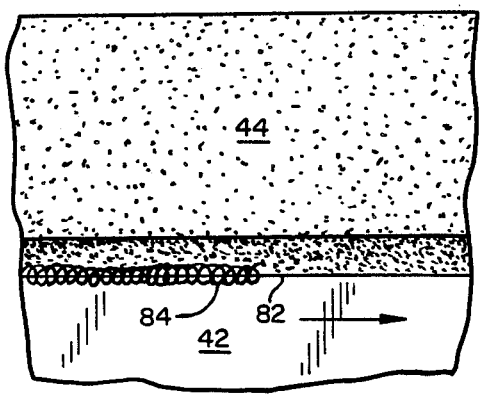
FIG. 6 is an enlarged view as if taken on view line 6—6 of FIG. 5, schematically illustrating the concept of focused orbital laser welding of the cutting element and base link.

The bonding process is illustrated in FIGS. 5 and 6. The present invention recognizes what is believed to be a major contributor to the failure of prior bonding processes. The process of cutting aggregate materials with a chain saw generates extreme demands on all components of the saw chain. Whereas the steel links of a wood cutting saw chain have been highly developed to withstand severe impact forces, the demands of aggregate cutting are at least as severe as in wood cutting and will not tolerate a bonding technique that does not measure up to these extreme demands.

There are two major reasons for the problem of welding the matrix blocks 44 to saw chain links. The first is the small size of the link which itself creates a double problem. The parts are difficult to handle, as when brazing, and the brazing flux is difficult to control and can get into the rivet openings. More importantly is the limited volume or mass of material for absorbing heat. Welding processes like brazing generate extreme temperatures. These temperatures can be absorbed in the large steel blade of the prior art. However, in the relatively small size of the saw chain link, the temperature of the link quickly raises to the point where a drawing effect results. That is, the properties of heat treatment are reversed and the steel returns to a soft condition. It then rapidly wears under the very difficult conditions of concrete cutting.

The second problem is the high carbon content of the steel that makes up the saw chain. This high carbon steel can be very accurately heat-treated to obtain the desired properties of hardness and ductility necessary to saw chain cutting. However, a rapid rise or fall of temperature has a detrimental effect. Laser welding, which avoids some of the problems of brazing, creates a problem in this respect. Laser welding is accomplished with a highly focused beam that creates a rapid heat build-up in a narrow zone. The cool down in an atmospheric environment is also very rapid and causes stress risers. The stress risers induce failure of the bond.

The conclusion that is reached from this analysis is that the welding must be achieved without exposing the link in its entirety to high temperatures (as in brazing) which softens the steel and causes rapid wearing; and without exposing a narrow area adjacent the juncture to a rapid rise and fall of even moderately high temperatures (as in laser welding) which causes stress risers.

The present process of bonding involves an improved process of laser welding. The beam is narrowed or focused to obtain the welding depth but is moved rapidly to reduce heat transfer to the adjacent steel material. Because the precise juncture line is very difficult to follow (which generally requires the broader laser beam), a concept of orbital welding was developed. Thus the laser welding process involves the combination of a focused or narrow laser beam that is rapidly moved in an orbital pattern. This process is schematically illustrated in FIGS. 5 and 6. A cutting block 44 is shown being laser welded onto the support portions of a pair of side links 42. The laser 78 emits a laser beam 80 that is finely focused (by lenses not shown) and moved in an orbital path as it is directed down the juncture 82 between the side link portion 42 and block 44. The overlapping circular movement of the laser beam (the orbital movement) crosses back and forth over the juncture 82 as indicated by the orbiting path 84 in FIG. 6. When the weld is completed, the entire cutting element is placed in a 500 degree Fahrenheit furnace and gradually cooled. The orbital welding creates a much broader heat zone and, in conjunction with the controlled cooling, avoids the damaging stress risers.

As previously explained, the narrowed beam is moved rapidly in the orbital pattern indicated by path 84 and accomplishes a reliable weld between the block and flange but without generating the damaging stress risers. The technique of a focused beam directed in an orbital welding pattern is not new as a general concept, but it is believed that the concept has never been applied to the bonding of a cutting matrix cutting block to a saw chain link so as to avoid the damaging stress risers. This welding concept solves the very significant bonding problem that heretofore prevented the successful application of saw chain for cutting aggregate.

With the solution of the bonding problem, the problems of abrasive wear and adhesive wear then become the hurdle to cross and this has been achieved by the dissimilar materials described above the unique flushing system also described.

Others will conceive variations to the embodiments disclosed herein upon deriving a full appreciation of the improvements that are described. The inventions are not limited to the specific embodiments and the scope of the invention is to be determined by the claims appended hereto.

We claim:

1. A chain saw for cutting aggregate material comprising;

a saw chain, a guide bar having a rear end and a forward rounded nose end, and a chain drive mechanism, said guide bar having a guide edge including a saw chain guide groove and guide rails extended along the sides of the guide groove and around the nose end, and said saw chain having pivotally interconnected center links and side links, said center links having depending tang portions that are slidingly guided in the guide groove of the guide bar, and said side links having bottom edges that slidingly engage and ride on the guide rails of the guide bar, cutting blocks having an outer surface of a diamond impregnated matrix material, certain of the pairs of side links designated as cutting block supporting side links, said pair of supporting side links having top support edges, and said cutting block extended across the support edges of the pair of supporting side links and being bonded to both of said top support edges, certain other of the pairs of side links alternating with said cutting block supporting side links designated as depth gauge links having upwardly extended spaced apart depth gauge portions, and said guide bar including a plurality of enclosed fluid flow channels including a main channel extending forwardly from the rear end of the guide bar substantially the length of the guide bar, and feeding channels directed from said main channel and opening into the guide bar groove at spaced intervals along the periphery of the guide bar edge, and connection means for connecting flow of a fluid source from the rear end of the guide bar along a passageway define by the main and feeding channels, into the guide bar groove and through the spaced apart depth gauge side links to flush abrasive particles from the bar and saw chain components and away from the kerf being cut, and said fluid flow channels cooperatively configured to be less restrictive progressing from the rear end to the nose end to provide substantially equalized flushing at the nose end of the bar.

2. A chain saw for cutting aggregate material comprising;

a saw chain, a guide bar having a rear end and a forward rounded nose end, and a chain drive mechanism, said guide bar having a guide edge including a saw chain guide groove and guide rails extended along the sides of the guide groove and around the nose end, and said saw chain having center links and side links pivotally interconnected by rivets projected through rivet holes provided in the links, said center links having depending tang portions that are slidingly guided in the guided groove of the guide bar, and said side links having bottom edges that slidingly engage and ride on the guide rails of the guide bar, cutting blocks having an outer surface of a diamond impregnated matrix material, certain of the pairs of side links designated as cutting block supporting side links, said pair of supporting side links having top support edges, and said cutting block extended across the support edges of the pair of supporting side links and being bonded to both of said top support edges, the above-described saw chain and guide bar components in the cutting operation encompassing a total of three friction producing opposed bearing surfaces including the center link tang portions sliding in the guide bar groove, the side link bottom edges sliding on the guide bar rails and the rivets turning in the rivet holes of the saw chain links, said bearing surfaces subjected to sufficiently high temperature to induce adhesive wearing by friction welding, said opposed bearing surfaces provided with dissimilar metals to inhibit wearing causing by such friction welding.

3. A chain saw as defined in claim 1 wherein the feeding channels project at an angle outwardly and forwardly from the main channel toward the nose end of the guide bar.

* * * * *